US006089938A

United States Patent [19]

Spector

[11] Patent Number: 6,089,938

[45] Date of Patent: Jul. 18, 2000

[54] FIGURATIVE FLYING DISC TOY

[76] Inventor: Donald Spector, 380 Mountain Rd., Union City, N.J. 07080

[21] Appl. No.: 09/224,404

[22] Filed: Dec. 31, 1998

[51] Int. Cl.[7] ..... A63H 27/00

[52] U.S. Cl. ..... 446/46; 473/588

[58] Field of Search ..... 446/46, 901, 385, 446/387, 234, 251, 47, 48, 97, 99; 473/588, 589

[56] References Cited

U.S. PATENT DOCUMENTS

| | | | |
|---|---|---|---|
| 5,288,261 | 2/1994 | Spector | 446/267 |
| 5,338,027 | 8/1994 | Rehkemper et al. | 446/46 |
| 5,649,875 | 7/1997 | Spector | 473/596 |

*Primary Examiner*—Sam Rimell

[57] ABSTRACT

A figurative flying disc toy constituted by an inverted plastic dish having a convex annular rim and soft appendages hinged thereto to impart to the toy the form of a humanoid figure. Each appendage is composed of a fabric pouch stuffed with compressible material, the pouch being shaped and printed to simulate in one appendage the head of the figure and in the other appendages, the arms and legs thereof. To launch the toy, a player grasps one of the appendages which then serves as a handle, and with a flick of the wrist to cause the disc to whirl, the disc is hurled into the air and let fly. The centrifugal forces produced in the flight by the whirling disc causes the hinged appendages to extend outwardly to stabilize the flight.

7 Claims, 1 Drawing Sheet

FIGURATIVE FLYING DISC TOY

BACKGROUND OF THE INVENTION

1. Field of Invention

This invention relates generally to flying disc toys, and more particularly to a toy of this type having soft appendages hinged thereon to impart to the toy the appearance of a humanoid figure.

2. Status of Prior Art

FRISBEE is the trademark for a flying disc toy formed by a molded plastic dish having a convex annular rim which players throw and catch. This toy has acquired the status of a classic, for it is as popular today with adults as well as children as it was a quarter of a century ago.

In launching a flying disc, the player grasps the rim with one hand, and with a flick of the wrist to impart a whirling motion to the disc, the disc is hurled into the air and let fly. But though the flying disc is formed of a resilient plastic material, it is not entirely safe. If the disc which travels at a fairly high velocity is not caught by a player, but strikes his head or any other vulnerable site on the player's body, the disc may inflict injury.

Another drawback of a conventional FRISBEE is that its aerodynamic characteristics give rise to an uncertain flight pattern which depend on how the disc is thrown into the air by the player. Thus in many cases the flying disc may travel in a curved trajectory, and as a consequence, will not fly in the direction the catcher.

My prior U.S. Pat. No. 5,288,261 (Spector) discloses a figurative toy missile in a humanoid form. By humanoid form is meant a figure having a head, arm appendages and leg appendages, but otherwise not resembling a human being.

The missile disclosed in this patent is defined by a torso formed by an outer fabric casing enclosing an inflated rubber balloon, a head being joined to this torso as well as arm and leg appendages. When a player grasps one of these appendages, and throws the missile into the air, it will spin or execute other excursions in flight depending on how the appendage is handled by the player. But a figurative toy missile of this type does not have the flying characteristics of a Frisbee which is capable of flying long distances away from the player who throws it.

SUMMARY OF INVENTION

In view of the foregoing, the main object of this invention is to provide a figurative flying disc having the appearance of a humanoid figure, the flying disc being capable of travelling long distances.

More particularly, an object of the invention is to provide a figurative flying disc of the above type having soft appendages hinged thereto which serve not only to stabilize the flight characteristics of the disc but also to make it safer to play with, for should the flying disc strike a player or another individual, the impact will be cushioned by at least one of the soft appendages.

A significant advantage of a figurative flying disc in accordance with the invention, is that each appendage hinged thereto can serve as a handle to facilitate the launching of the disc.

Briefly stated, these objects are attained by a figurative flying disc toy constituted by an inverted plastic dish having a convex annular rim and soft appendages hinged thereto to impart to the toy the form of a humanoid figure. Each appendage is formed by a fabric pouch stuffed with compressible material, the pouch being shaped and printed to simulate in one appendage the head of the figure and in the other appendages, the arms and legs thereof.

To launch the toy, a player grasps one of the appendages which then serves as a handle, and with a flick of the wrist to cause the disc to whirl, the disc is hurled into the air and let fly. The centrifugal forces produced by the whirling disc in flight causes the hinged appendages to extend outwardly to stabilize the flight.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
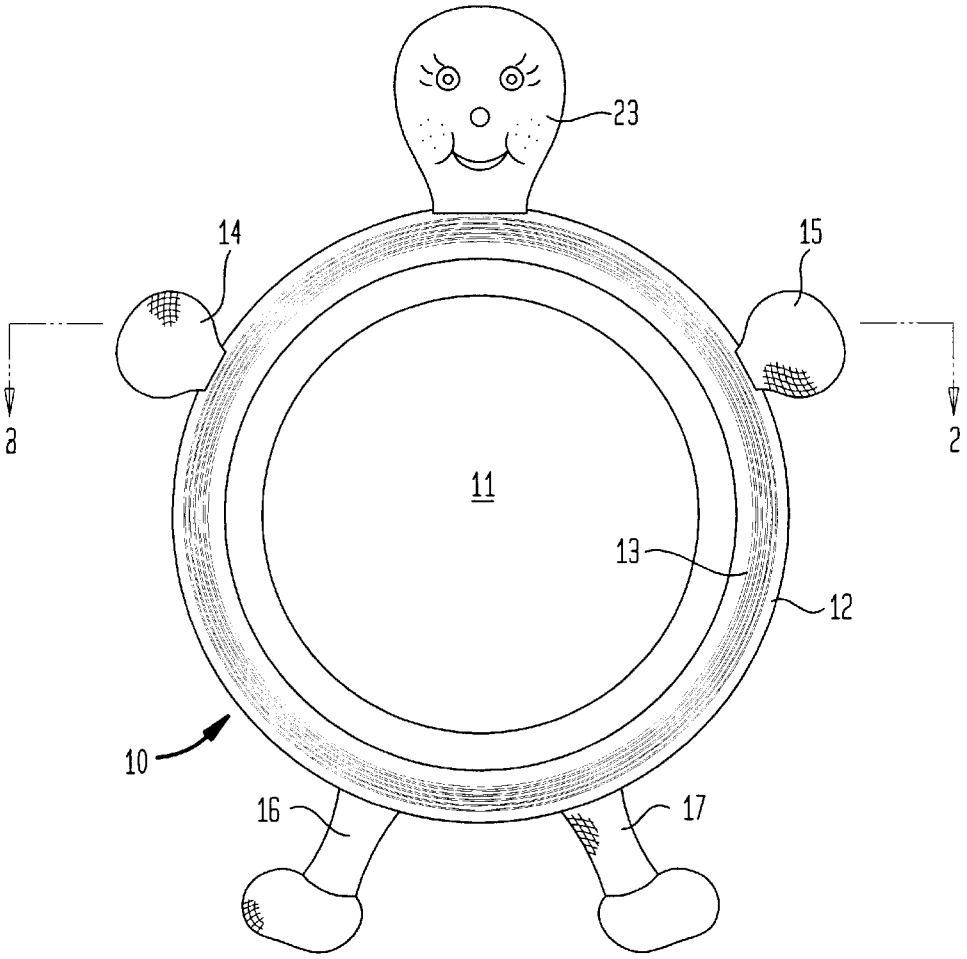
FIG. 1 is a plan view of a figurative flying disc in accordance with the invention.
Figure 2:
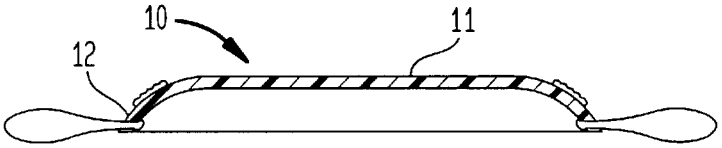
FIG. 2 is a section taken in the plane of line 202 in FIG. 1.

Referring now to FIGS. 1 and 2 of the drawing, it will be seen that a figurative flying disc toy in accordance with the invention includes an inverted dish 10 molded of synthetic resilient plastic material, such as polyethylene. Dish 10 has a flat circular disc section 11 surrounded by an annular rim 12 having a convex curvature to create under the inverted dish an air zone Z that plays a role in the aerodynamic characteristics of the flying disc. To enhance these characteristics, molded into the dish in a zone encircling disc section 11 is an array of concentric circular ridges 13.

Hinged to annular rim 12 at appropriate sites are soft appendages 13 to 17 what impart to the toy the stylized form of a humanoid figure.

Figure 3:
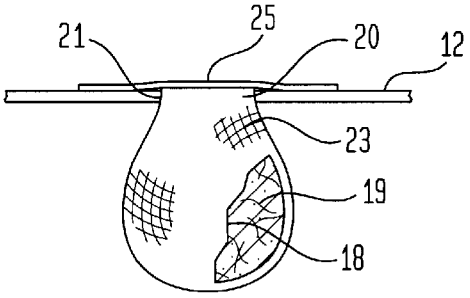
FIG. 3 is a cut away view of one of the appendages.

Each appendage, such as appendages 13 shown separately in FIG. 3, is composed of a fabric pouch 18 fabricated of high-strength nylon or other synthetic fibers, the pouch being stuffed with fiberfill fibers 19 of other compressible filler material of the type used to stuff pillows. Hence the appendages have the softness of a pillow.

The fabric mouth of the pouch is flattened to form a tongue 20 that is inserted in a slot 21 cut in rim 12 of the dish. Tongue 20 is sealed and is secured to the inner wall of rim 12 by an adhesive tape 21. Thus each appendage is hingedly joined by its tongue to the rim of the flying disc and dangles therefrom so that the appendages can swing toward or away from the flying disc.

Appendage 13 which is aligned with the North pole of the flying disc is shaped and printed to simulate the head of the humanoid figure. In appendage 13 the eyes, ears, a nose, mouth and other facial features are printed on the face of the pouch in appropriate colors. The head appendage may be that of a fanciful figure or that of a well-known character, such as a TV personality, a renowned athlete or a movie star.

Appendages 14 and 15 which are hingedly joined to rim 12 on opposite sides of the head at North-East and North West sites are shaped and printed to suggest the arm and hands of this figure. And appendages 16 and 17 which are positioned on opposite sides of the South pole are shaped and printed to suggest the legs and feet of the figure whose torso is simulated by the flying disc.

Each appendage serves as a possible handle for the flying disc, and instead of throwing the disc by grasping its rim as with a FRISBEE, the player grasps one of the appendages, and hurls the flying disc into the air using the same wrist motion for this purpose to cause it to whirl as he would had the rim been engaged.

However, the appendages do more than simulate a humanoid figure and provide a handle for a flying disc, for the appendages act to enhance the aerodynamic characteristics of the flying disc. When the whirling disc is in flight, the resultant centrifugal forces cause the hinged appendages to extend outwardly to create fins rotating in an orbit. These act to stabilize the flight pattern and to create a straight line trajectory.

Hence when a player throws the toy in the direction of another player, it will travel in that direction so that it can be caught, and not swerve away from the catcher as often happens with a conventional Frisbee.

And should the flying disc not be caught but strike the player or any other individual, the force of impact will be cushioned by whichever soft appendage makes contact with the person struck, so that the person will not be injured even if the flying disc strikes hard.

While there has been shown and described a preferred embodiment of a figurative flying disc toy in accordance with the invention, it will be appreciated that many changes and modifications may be made therein without, however, departing from the essential spirit thereof.

I claim:

1. A figurative flying disc toy comprising:

A. A flying disc in the form of an inverted dish having an annular curved rim surrounding a substantially flat central section; and B. A plurality of soft appendages hingedly joined to the rim, said appendages being shaped and printed respectively to simulate a head, arms and legs of a humanoid figure whereby a player grasping any one of these appendages and hurls the flying disc into the air so that it whirls in the course of flight, the appendages then as aa result of centrifugal forces extend outwardly to stabilize the flight, each appendage being formed by a fabric pouch stuffed with a compressible filler, and having a mouth that is flattened to form a tongue that is inserted in a slot cut in the rim, thereby to hinge the pouch to the rim.

2. A toy as set forth in claim 1, in which the dish is molded of resilient synthetic plastic material.

3. A toy as set forth in claim 2, in which the rim has a convex cross section, and molded in on the rim in a zone encircling the central section is an array of concentric ridges.

4. A toy as set forth in claim 1, in which the filler is fiberfill.

5. A toy as set forth in claim 1, in which the pouch which forms the head appendage has printed thereon the facial features of the humanoid figure.

6. A toy as set forth in claim 5, in which the head of the humanoid figure resembles the head of a well-known character.

7. A toy as set forth in claim 1, in which the end of the tongue is sealed by an adhesive take that attaches the tongue to an inner wall of the rim.

* * * * *